United States Patent [19]

Benner

[11] Patent Number: 4,899,882

[45] Date of Patent: Feb. 13, 1990

[54] HANGING TAG PACKAGE ASSEMBLY

[76] Inventor: Cecilia Benner, 121 Elm Park, Pleasant Ridge, Mich. 48069

[21] Appl. No.: 353,745

[22] Filed: May 18, 1989

[51] Int. Cl.[4] ..... B65D 73/00

[52] U.S. Cl. ..... 206/470; 206/45.34; 206/806; 206/459

[58] Field of Search ..... 206/470, 806, 45.34, 206/459

[56] References Cited

U.S. PATENT DOCUMENTS

| | | | |
|---|---|---|---|
| 3,327,843 | 6/1967 | O'Meara et al. | 206/470 X |
| 3,904,029 | 9/1975 | Koltz | 206/45.34 |
| 4,356,919 | 11/1982 | Matney | 206/470 |
| 4,378,068 | 3/1983 | Bell | 206/470 X |
| 4,499,353 | 2/1985 | Shields | 206/470 |
| 4,630,734 | 12/1986 | Severin et al. | 206/806 |
| 4,739,883 | 4/1988 | Mohs et al. | 206/470 |

*Primary Examiner*—William Price

*Attorney, Agent, or Firm*—Arnold S. Weintraub; Roland W. Norris

[57] ABSTRACT

A combination transparent container and hanging tag. The container has a hinged lid and a product-receiving base. The hanging tag is of one piece foldable material dimensioned to be folded at one end within the container and at its other end folded so as to pass outside of the container between the lid and the base walls. This outside end of the foldable material has a through-hole thereby forming a hanging tag for suspending the combination. The foldable material may be imprinted to carry promotional advertising on the outside end and all necessary information for a product within the container. The foldable material may also carry the product prior to its insertion into the box to facilitate the packaging process. The tag portion and container portion of the combination are not fixedly attached to each other.

17 Claims, 2 Drawing Sheets

FIG 1
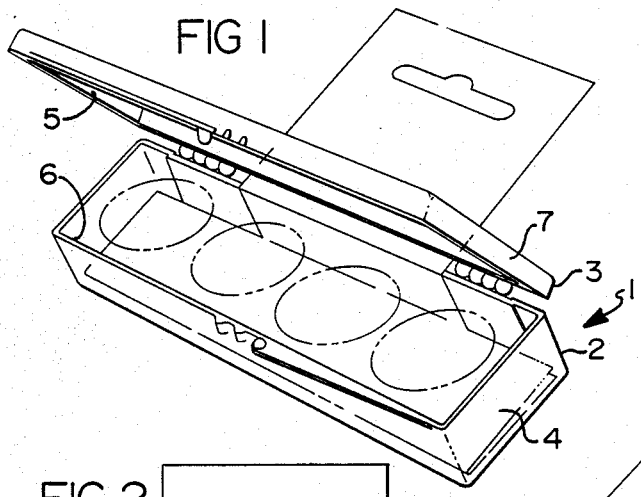
FIG 7
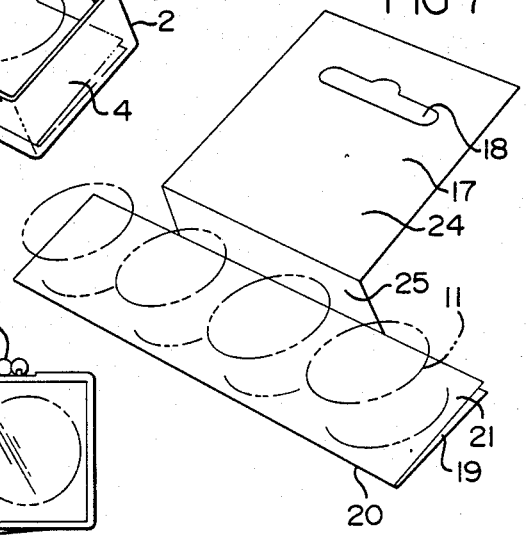
FIG 2
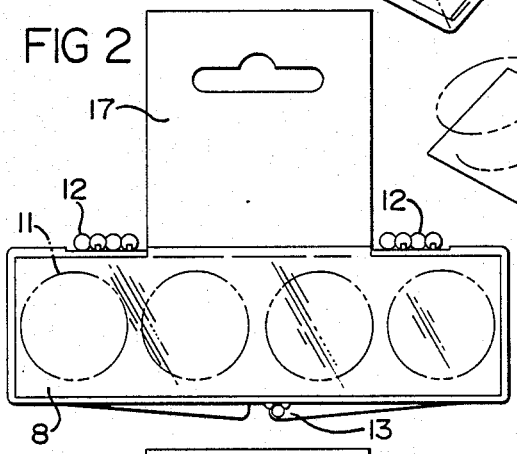
FIG 6
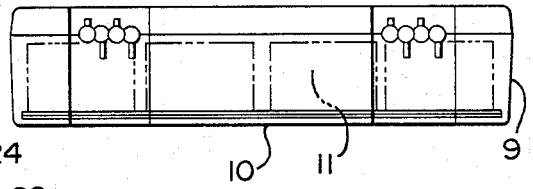
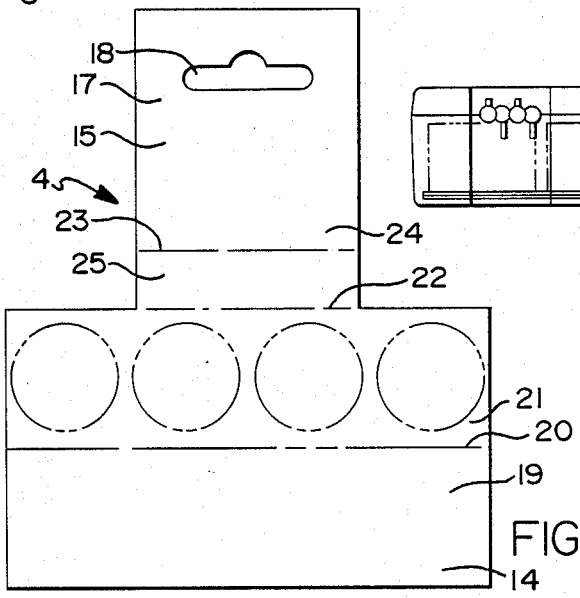
FIG 5

FIG 8
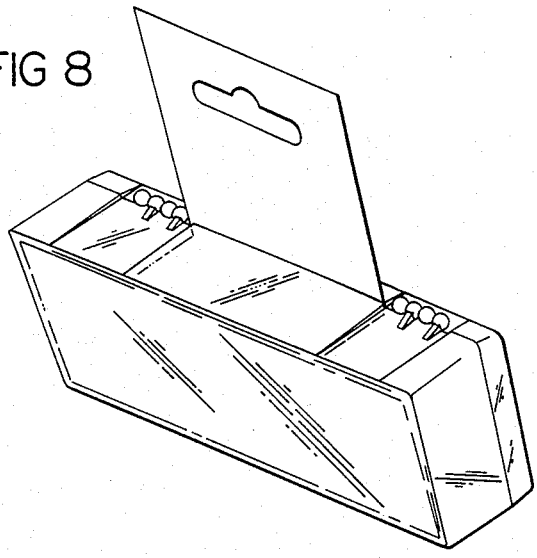
FIG 3
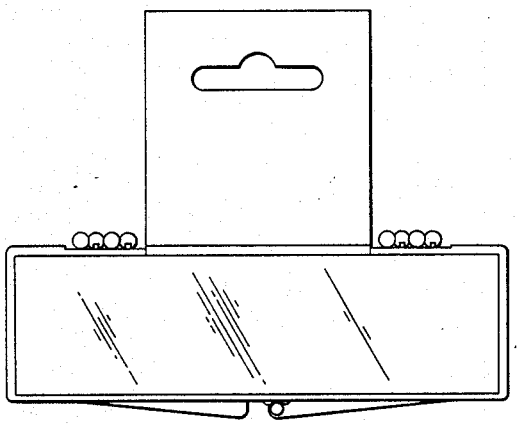
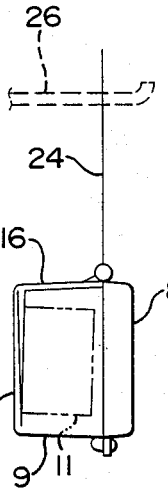
FIG 4
FIG 9
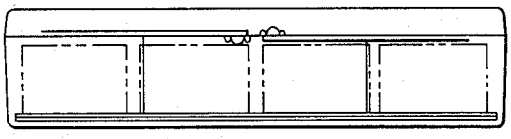

HANGING TAG PACKAGE ASSEMBLY

BACKGROUND OF THE INVENTION

1. Field of the Invention

The present invention relates to an apparatus for display of, and packaging assembly for, a product container. More particularly, the present invention relates to a combination lidded box-like container and foldable insert which forms a hanging tag for the package outside the container and a series of folds within the container. The insert is provided with means to attach a commercial product thereto.

2. Description of Relevant Art

There are known several package configurations having inserts or tags which extend externally of the package and which provide holes for suspending the package on a hook or the like and which may carry printed matter thereon.

For example, Mohs et al, U.S. Pat. No. 4,739,883, discloses a reusable package with cooperating inscription card. The flat card has two smaller holes which mate with two protrusions of the display package. The package is formed from thin flexible thermoplastic material.

Kay et al, U.S. Pat. No. 4,456,124, discloses a combined container and support tag for supporting and displaying a product in a readily visible package. The support tab may be made of cardboard or plastic, and includes a cutout through which the container fits in an interlocking manner.

Fox II, U.S. Pat. No. 3,811,563, discloses a package designed to hold a second car key. The package is adapted to be secured to a display card, the card including appropriate advertising material and pictures. The package is designed to have spaces in the hinge and clamp areas to accommodate the width of the card. The package is then fastened over cutouts in the card.

Also, a folded insert which suspends a rigid container of mounting devices to be inserted into the drywall of homes has been seen commercially in hardware stores.

However, none of the aforementioned devices provides a foldable insert with adequate space for detailed product information. This detailed product information may be mandated by law, such as Noise Reduction Rating information required by the Federal Environmental Protection Agency for earplugs and the like, on either the interior or exterior of the container, or both. Further, the aforementioned devices do not provide a means for attaching a commercial product to the foldable insert. Thus, the insert and the product must be inserted separately, needlessly complicating the packaging process of a commercially ready container, tag, and product assembly.

The current invention overcomes these shortcomings by providing a foldable hanging tag which can carry a great deal of product information within its folds. The tag may then be folded to selectively display desired information within the closed package and provide a hanging tag external to a rigid package. The information desired to be displayed within the package can face a bottom transparent surface for viewing. The tag is folded so that it conforms to the bottom and back wall of the box and is provided with means to carry the product thereon if so desired.

SUMMARY OF THE INVENTION

The present invention provides a combination reusable product container and foldable tag for suspending the container from a display stud or the like. The foldable tag is especially useful for suspending a rigid container where both the lid and base have a depth. Where legally mandated information must be displayed with the product, the tag may be folded to place the information and majority of the tag entirely within a transparent case, while allowing a portion of the tag to be displayed exteriorly. The folds allow the tag to conform to the bottom base wall and back base wall.

A portion of the tag exits the container between the lid and base. This external portion has a through-hole thereby providing a means for suspending the closed container. This external portion of the tag may also be imprinted with suitable indicia.

If a transparent container is used, the folds may be placed so as to selectively display desired information from within the closed package.

Further, the tag may have the product affixed thereto to provide for efficient packaging of the product by the manufacturer.

For a more complete understanding of the present invention, reference is made to the following detailed description and accompanying drawing. In the drawing, like reference characters refer to like parts throughout the several views, in which:

BRIEF DESCRIPTION OF THE DRAWINGS

FIG. 1 is a right side perspective view of the package and hang tag combination in accordance with the present invention.

FIG. 2 is a top view hereof.

FIG. 3 is a bottom view hereof.

FIG. 4 is a left side view hereof.

FIG. 5 is a front view of the tag in its unfolded state.

FIG. 6 is a rear elevation of the package and hang tag combination.

FIG. 7 is a perspective view of the folded tag.

FIG. 8 is a rear perspective view of the package and hang tag combination.

FIG. 9 is a front elevation of the package and hang tag combination.

DETAILED DESCRIPTION OF THE PREFERRED EMBODIMENT

As seen in FIG. 1, the preferred embodiment of the current invention comprises a transparent container 1 having a base 2 and a lid 3. Folded within the container 1 is a portion of tag 4. A portion of tag 4 also extends externally from the container 1.

The container 1, preferably, is a rigid rectangular box whose lid 3 has a shallow cavity 5 formed by lid side walls 7 and lid top plate 8. The base 2 has a deeper base cavity 6 formed by base side walls 9 and base plate 10. This base cavity is intended to receive a product 11.

The back or rear side-wall of lid 3 is interconnectable to the back side-wall of base 2, as by two interlocking ball hinges 12 such as are known in the art. At the front side-walls of the lid 3 and base 2 is a releasable clasp mechanism 13 for securing lid 3 and base 2 together to form a closed container such as shown in FIG. 4.

The tag 4 as best seen in FIG. 5, is a flat, foldable sheet capable of carrying printed information or indicia thereon. Preferably, the tag is made from a high fiber paper but may also utilize any foldable material capable of holding its folded shape and being printed thereon.

In the preferred embodiment the tag 4 comprises two sections: a broad section 14 whose width conforms to the interior width dimension of base cavity 6, and whose length is determined by the amount of printed information needed to be placed thereon; and a narrow section 15 whose width is substantially determined by the distance between the two interlocking ball hinges 12, and whose length is determined by the height of the back base side-wall 16 and the desired length of the external portion of the tag 17 which extends externally from the container 1. The external portion 17 has a through-hole 18 located substantially at that end extending farthest from container 1.

In the preferred embodiment both sides of tag 4 are printed with product information and/or advertising. The bottom section 19 of broad section 14 is then folded at a first fold line 20 to fit beneath the top section 21 of broad section 14, thereby forming layered panels of tag. The panel dimensions conform to the area of base plate 10. It is possible a series of bottom section panels may be used if extensive information need be supplied with the product. It is, also, possible that the product 11 may be attached to the front of top section 21 if desired, for ease of packaging.

After broad tag section 14 is folded, a second fold is made on the boundary of broad tag section 14 and narrow tag section 15 along a second fold line 22. This second fold is made so as to leave the front of top section 21 and the front of narrow tag section 15 facing each other in perpendicular relation, as best seen in FIG. 4.

A third fold is provided along a third fold line 23 dividing narrow tag section 15 into two parts. The third fold is located at a distance from the narrow tag section 15 from the second fold line 22 approximately equal to the height of back base side-wall 16. This third fold is made so as to leave the back of upper narrow tag part 24 facing the back of lower narrow tag part 25 in perpendicular relation, as best seen in FIG. 4.

The product 11 to be placed within the container 1 may be removably affixed to the tag 4, such as by a tacky adhesive to allow for easy removal. Preferably, the product is affixed to the tag 4 at the top section 21 of broad section 14 to allow the product to be viewed through the lid 3 of a transparent container.

The tag 4 is then inserted in container 1 such that the folds of broad tag section 14 and any attached product 11 occupy the base cavity 6; lower narrow tag part 25 conforms to the inside of back base side wall 16 and upper narrow tag part 24 extends externally of the container between lid 3 and base 2 and in between interlocking ball hinges 12. The edge of rear base wall 16 which opposes lid 3, and the corresponding edge of lid 3, are dimensioned to provide a gap between the ball hinges 12 such that when lid 3 is in the closed position, the narrow tag section 15 may fit therebetween.

Upper narrow tag part 24, with a through-hole 18 located therein, forms a hanging means to suspend the entire assembly from a display hook 26.

Although there has been described what is at present considered to be the preferred embodiment of the present invention, it will be understood that the invention may be embodied in other specific forms without departing from the spirit or essential characteristics thereof. The present embodiment is therefore to be considered in all aspects as illustrative an not restrictive. The scope of the invention is indicated by the appended claims rather than the foregoing description.

I claim:

1. A combination container and hanging tag comprising:

a box-like container having a lid and a base;

said lid being selectively removable from a covering engagement with said base;

a foldable tag;

said tag folded so as to form a first portion of said tag in a size which fits within said container; and a second portion of said tag extending exteriorly of said container between said base and said lid when the lid and the base are engaged;

said tag first portion having a plurality of folded panels which oppose each other in stacked layers;

said tag second portion having a means for suspending the container;

said tag first portion being further folded so as to place a part of said tag first portion in a position to support said container when said container is suspended by said tag second portion.

2. The combination of claim 1 wherein:

said container comprises a transparent material.

3. The combination of claim 1 wherein:

said container comprises a surface for receiving printed indicia.

4. The combination of claim 1 wherein:

said container comprises a rigid material.

5. The combination of claim 1 wherein:

said lid is interconnectable with said base.

6. The combination of claim 5 wherein:

said lid is secured in covering engagement with said base by means of a clasp.

7. The combination of claim 1 wherein:

said tag first portion folded panels, each carries printed indicia.

8. The combination of claim 1 wherein:

said tag has a product attached to it which further comprises: a product to be displayed detachably secured to said tag.

9. The combination of claim 1 wherein:

said means for suspending the container is a through-hole.

10. The combination of claim 1 wherein:

said tag is a paper tag.

11. A combination container and hanging tag, comprising:

a transparent tubular container having a lid and a base;

said lid being selectively removable from a covering engagement with said base;

a foldable tag;

said tag comprised of a material capable of receiving print over the surface area of said tag;

a first portion of said tag being fitted within said container;

a second portion of said tag extending exteriorly of said container between said base and said lid;

said second portion having means for attachment to a display rack;

said tag first portion having a plurality of panels which carry print and are folded so as to fit in a stacking relation within said base and leaving at least one of said panels readable through said transparent container;

said tag first portion having a product attached thereto;

said tag first portion being folded so as to place a part of said tag first portion substantially perpendicular to said tag second portion;

whereby said tag suspends said container from a display rack while allowing the product and printed information within the container to be viewed.

12. The combination of claim 11 wherein:

said lid is hingedly connected to said base at a rear wall of said container.

13. The combination of claim 12 which further comprises:

said lid capable of being secured in covering engagement with said base by means of a clasp.

14. The combination of claim 11 wherein:

said means for attachment is a through-hole located on said second tag portion.

15. A combination container and hanging tag, comprising:

a transparent box-like container having a lid and a base;

said lid being selectively removable from a covering engagement with said base;

a foldable tag;

said tag being printed over the surface area of said tag;

a first portion of said tag being fitted within said container and being dimensioned so as to substantially conform to the area of an interior surface of the container;

a second portion of said tag extending exteriorly from said container;

said tag second portion being relatively more narrow than said tag first portion;

said tag second portion also having print thereon;

said tag second portion having means for coupling with a display rack;

said tag first portion having a plurality of panels which carry print and are folded so as to fit in a stacking relation within said base;

at least one of said panels being readable through said transparent container;

said tag first portion having a product attached thereto;

saidi tag first portion being folded so as to place a part of said tag first portion substantially perpendicular to said tag second portion;

whereby said tag suspends said container from a display rack while allowing the product and printed information within said container to be viewed.

16. The invention according to claim 15 wherein:

said lid is hingedly attached to said base and secured by a clamp.

17. The invention according to claim 16 wherein:

said container is rigid.

* * * * *